US008550004B1

(12) United States Patent
Woo et al.

(10) Patent No.: US 8,550,004 B1
(45) Date of Patent: Oct. 8, 2013

(54) RIVETED CARTRIDGE VENTING

(75) Inventors: Timothy Woo, Flushing, NY (US); Leon Moy, Montclair, NJ (US); Bishara Elmasri, Landing, NJ (US); Christina Morales, Mine Hill, NJ (US); Alan N. Cohen, Wharton, NJ (US); Daniel Lee Prillaman, Montclair, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/487,688

(22) Filed: Jun. 4, 2012

Related U.S. Application Data

(63) Continuation-in-part of application No. 12/905,249, filed on Oct. 15, 2010, now abandoned.

(60) Provisional application No. 61/253,625, filed on Oct. 21, 2009.

(51) Int. Cl.
*F42B 39/20* (2006.01)

(52) U.S. Cl.
USPC ..... 102/430; 102/481

(58) Field of Classification Search
USPC ..... 102/481, 469, 430, 470
See application file for complete search history.

(56) References Cited

U.S. PATENT DOCUMENTS

| | | | | |
|---|---|---|---|---|
| 5,035,181 | A * | 7/1991 | Jacks et al. | 102/481 |
| 5,036,658 | A * | 8/1991 | Tate | 60/253 |
| H1144 | H * | 3/1993 | Cherry et al. | 60/39.1 |
| 5,311,820 | A * | 5/1994 | Ellingsen | 102/481 |
| 5,398,498 | A * | 3/1995 | Mort et al. | 60/223 |
| 6,523,477 | B1 * | 2/2003 | Brooks et al. | 102/481 |
| 6,752,085 | B2 * | 6/2004 | Roach | 102/481 |
| 7,025,000 | B1 * | 4/2006 | Wong et al. | 102/481 |
| 7,322,295 | B1 * | 1/2008 | Haeselich | 102/470 |
| 7,331,292 | B1 * | 2/2008 | Kim et al. | 102/481 |
| 7,739,956 | B2 * | 6/2010 | Ljungwald et al. | 102/481 |
| 8,381,656 | B1 * | 2/2013 | Woo et al. | 102/481 |
| 2012/0204750 | A1 * | 8/2012 | Sullivan et al. | 102/430 |

* cited by examiner

*Primary Examiner* — Michael Carone
*Assistant Examiner* — Reginald Tillman, Jr.
(74) *Attorney, Agent, or Firm* — Henry S. Goldfine

(57) ABSTRACT

An IM type steel cartridge whose base contains a central bore there through—within which bore is a steel base plug holding a primer cup, the base plug being held in place by a low melt, 220 to 250 degree F. melt eutectic solder—wherein, if the cartridge is subjected to an unforeseen thermal or kinetic event, the solder will melt, the base plug ejected, and the propellant will vent rather than explode. The solder bond between the base plug and the cartridge case within which it is held is capable of resisting the from about 72,000, to up to 90,000 psi, force generated within the firing chamber of the weapon by the ignition and firing of the cartridge.

9 Claims, 1 Drawing Sheet

RIVETED CARTRIDGE VENTING

CROSS-REFERENCE TO RELATED APPLICATIONS

This application is a continuation-in-part of currently U.S. patent application Ser. No. 12/905,249 filed Oct. 15, 2010, now abandoned, which claims the benefit under 35 USC §119(e) of U.S. provisional patent application 61/253,625, filed on Oct. 21, 2009.

STATEMENT REGARDING FEDERALLY SPONSORED RESEARCH OR DEVELOPMENT

The invention described herein may be made, used, or licensed by or for the United States Government, for Government purposes, without the payment of any royalties therefore.

BACKGROUND OF THE INVENTION

1. Field of the Invention

The present invention relates to the field of Insensitive Munitions (IM), and, more particularly, to a new and simplified mechanism for reducing the vulnerability of propellant loaded cartridges from suffering explosive events due to unplanned thermal stimuli.

2. Description of Related Art

Newer munitions are designed to minimize a violent, i.e. explosive, response when subjected to unintended stimuli during transportation and storage, such munitions are generally known as insensitive munitions or simply as, IM. Generally, such IM type munitions are provided with means to vent themselves—such that when unintentionally subjected to heat or kinetic energy from an accident, a fire, or as the result of enemy action—the venting avoids pressure build-up if the cartridge propellant is ignited and the propellant will then tend to burn rather than explode.

Standards have been established for Insensitive Munitions, wherein the particular munition must pass Fast Cook-Off (FCO) and Slow Cook-Off (SCO) test requirements of MIL-STD-2105B, "Military Standard for Hazard Assessment Tests for Non-Nuclear Munitions". In a typical Fast Cook-Off test, the munition is engulfed in the flames of a jet fuel (or gasoline) fire exhibiting a minimum average temperature of 1,600.degree. F., to assess its response to rapid heating. In the Slow Cook-Off test, the munition is heated in a closed chamber at a linear rate of 6.degree. F. per hour until a reaction occurs, to assess its response to gradual heating. The FCO and SCO tests are considered to be passed if the munition exhibits a Type V response where the test items only burn or scatter lethal fragments no further than 50 feet from the burn pan or test oven.

The concept of venting to avoid pressure build-up and eliminate the danger of igniting surrounding material or atmosphere was disclosed in U.S. Pat. No. 2,644,059, issued Jun. 30, 1953, to Jones, with respect to electric fuses enclosed within a cartridge. In this case, if the fuze link were blown by an over-current or even by a short circuit, the gas pressure created thereby would be vented through sections of the ends of the cartridge which included a porous type metal known as Porex—a metal capable of withstanding the pressures that are built up within the cartridge while allowing the pressures to be bled off.

While the solution of U.S. Pat. No. 2,644,059 of using a porous type metal sufficed to vent the relatively small pressure build-up within a fuze, it is not adequate to provide the venting for an event impacting the propellant within a cartridge itself, or the propellant within rocket, or an explosive loaded cartridge—where significant venting is required to avoid pressure build-up and an explosive situation. In contrast, U.S. Pat. No. 7,025,000 (Wong et al.) does provide such relatively massive venting —disclosing use of a plastic threaded adaptor having a melting temperature that is lower than the auto-ignition temperature of the explosive within the particular munition. This adaptor secures a fuze or metal closing plug to an explosive loaded projectile and is designed to permit significant venting of combustion gases through the nose of the projectile upon auto-ignition of the explosive, thereby providing an enlarged venting area which in turn prevents detonation of the explosive and fragmentation of the projectile body. Similar to U.S. Pat. No. 7,025,000—U.S. Pat. No. 6,338,242 (Kim et al.) discloses a thermoplastic warhead adaptor which melts releasing a dome plug to provide again a significant vent opening, to reduce the danger of explosion from heat induced over-pressurization in rocket motors.

Other, similar patents, disclose munition venting systems to avoid explosive catastrophes. U.S. Pat. No. 3,927,791 (Hershberger) discloses a fusible plug assembly of a bismuth alloy that melts at approximately 210.degree. F. to permit venting. U.S. Pat. No. 4,557,198 (Hickey) discloses a venting aperture with two retaining means and a shear pin configuration. U.S. Pat. No. 4,991,513 (Malamas, et al.) discloses a plurality of vent holes in the nose section that are open when coincident with vent holes in a collar. In storage, the vent holes are left open with the placement of a safety pin, which is removed immediately prior to loading. U.S. Pat. No. 5,035,180 (Purcell, et al. '180) discloses a venting system having a metal patch attached to the casing that shears from the casing when heated. U.S. Pat. No. 5,035,182 (Purcell, et al. '182) discloses a vent system having a bi-metallic patch attached to the casing that deforms with heating, which then separates from the casing. U.S. Pat. No. 5,155,298 (Koontz) discloses a solder plug that forms the primary load carrying portion of a release mechanism mounted on the external side of a closure plate whose internal side holds the explosive within the warhead. Upon an unforeseen thermal event, the plug melts, no longer maintaining an expandable snap ring in an expanded position, such that the expanded snap ring retracts—without the closure force of the snap ring, a set of radial set screws will shear away, freeing an adapter plate that confines the closure plate against the explosive, thereby venting the pressure within the warhead case. U.S. Pat. No. 5,311,820 (Ellingsen) discloses a melting fusible material that allows a free-loaded spring retainer to push the melted or liquid fusible material out of a set screw hole, causing the nozzle to separate from the case at the interface. U.S. Pat. No. 5,337,672 (Boissiere, et al.) discloses a set of locking screws that secures a casing to a plug, with the locking screws designed to shear at a given pressure. U.S. Pat. No. 5,398,498 (Mort, et al.) discloses a fusible helical joint member made of a metallic material having a low melting point that melts when heated, allowing an adapter ring to disconnect the warhead from the rocket motor. U.S. Pat. No. 5,735,114 (Ellingsen) discloses a bimetallic retaining ring that releases the engagement between two or more sections of a rocket motor when contacted by an external heat source.

The various venting system solutions detailed above are uniformly not adequate for providing insensitive munition venting for centerfire medium (e.g. 25 mm, 30 mm, 50 caliber), and even large (e.g. 105 mm) caliber cartridges—wherein: (1) there is a physical environment, within a gun barrel, that does not allow for any mechanical devices about the cartridge; (2) the venting system must withstand pressures from about 72,000 up to about 90,000 psi without failing when the cartridge is fired and still provide adequate area for quick venting, i.e. simple plastic or metal closures, or patches, or the like, are not adequate; (3) due to the vast numbers of cartridges produced, the solution must be inexpensive, and (4) the solution cannot significantly change the configuration or weight of presently mass produced cartridges.

SUMMARY OF THE INVENTION

The primary objective of the present invention is that it meets the standards for an Insensitive Munition, i.e. passing the Fast Cook-Off (FCO) and Slow Cook-Off (SCO) test requirements of MIL-STD-2105B. Further and significant objectives of the present invention, which address the needs detailed above, including providing a means to vent centerfire medium and large caliber cartridges, without any weakness being created in the cartridge structure, without any mechanical device being added to the cartridge, without any significant change to the configuration or mass of the cartridge, and without adding any significant cost to the construction of the cartridge.

To realize the various objectives of the subject invention, the cartridge casing thereof is manufactured in two parts—all preferably of standard military grade cartridge steel—the first part being the cartridge body (which can be manufactured by conventional drawing means); the second part is a base plug, which is inserted into a generally circular bore, which bore is central to and within the base of the cartridge casing and incorporates a primer pocket, which pocket is located centrally within the base plug (i.e. the pocket holds a primary explosive, such that when the base of the primer pocket is impacted by the particular weapon's firing pin, the primary explosive will detonate, and thereby detonate the propellant housed within the body of the cartridge). The base plug is held in place by a preferably eutectic solder, i.e. a solder which melts at a single temperature, thereby going directly from a solid to a liquid state, and conversely going from a liquid to a solid state at a single temperature when cooled—which solder importantly has a melting point in the range of about 220 to about 250 degrees F. Critical to the present invention is the fact that such particular solder forms a strong bond to the steel cartridge casing on one side and the steel base plug on the other—which bond has surprisingly proven capable of withstanding pressures from about 72,000 psi, up to 90,000 psi, which are generated upon firing of the cartridge within the firing chamber of the particular weapon. Further, within the about 220 to about 250 degree F. melt temperature of the solder can be selected within the about 220 to about 250 degree F. range to be well below the about 270 to about 300 degree F. ignition temperature of the standard propellants used for military cartridges. Therefore, should an unforeseen catastrophic event occur and temperature and pressure within the cartridge rise causing the solder to melt, the base plug will be forced out from within and away from the cartridge casing by whatever pressure builds up in the cartridge—providing a large opening in the base of the cartridge casing, thereby venting the casing and relieving the pressure and temperature build-up avoiding any potential for the propellant's exploding.

A preferred embodiment cartridge of the present invention the base plug has a larger generally cylindrical lower section which forms the central portion of the base end of the cartridge and a narrower generally cylindrical portion which extends into the body of the cartridge—which configuration is reflected in a corresponding bore extending from the base end of the cartridge into the interior thereof. Such a preferred embodiment can be manufactured by first coating at least a portion of the generally cylindrical exterior surface of the base plug and the corresponding portions of the bore within the cartridge base—with a quantity of flux to remove any oxide from the generally cylindrical portions of the base plug and cartridge surfaces being bonded together. There are separations between the corresponding surfaces of the base plug and interior portions of the cylindrical bore, which separations are thin and elongated, being from about 0.002 to about 0.005 inches wide—which spacing is filled with the melt solder. The solder will fill the thin, elongated separations and any larger separation that may be provided and in the process displace any residual flux, which is forced out of the separations and can subsequently be washed away.

Also, preferably, a horizontal shoulder is provided that extends from the body of the cartridge into the generally cylindrical bore and a matching horizontal shoulder is provided within the base plug, such that, when the base plug is inserted into the bore, it will only travel therein until the respective shoulders abut, one-against-the-other, forming an abutment.

Once the base plug is in place within the bore and the melt solder has solidified, the bond between that particular solder (having eutectic melt points of from about 220 to about 250 degree F. melt temperature) forms a particularly strong bond to the steel cartridge body and steel plug, which bond can withstand the 90,000 psi force generated by firing of the cartridge from the weapon within which it is chambered. The primer containing cup is then force fit within a bore through the base plug—the primer cup is preferably also held in place with a structural adhesive—to ensure that it too can withstand the up to 90,000 psi.

In a more preferred embodiment, in addition to the bonded, thin, 0.002 to 0.005 inch elongated filled bonded lengths or sections between the bore within the base of the cartridge body and the plug—a larger opening can be filled with an enlarged cross-section of solder, coated on each side with flux; such that, there is additional bonding surface between the base of the cartridge body and the plug. This enlarged cross-section of solder can preferably be 10 times the width of the 0.002 to 0.005 thin elongated cross-sections of solder which are located within the body of the cartridge. Further, a thin cylindrical steel member can extend from the top of the steel base plug, i.e. extending into the cavity of the body of the cartridge which contains the propellant, and the upper portion of this vertical cylinder can be crimpled outwardly toward the body of the cartridge casing and down toward the base thereof—to be riveted over the top edge of the enlarged cross-sectional area of solder—physically holding it in place.

Particular eutectic melt point solders that are useful in the present invention, that have melt points in the range of about 220 to about 250 degrees Fahrenheit including a 52 wt % In/48 wt % Sn solder, aka In52 or Indalloy 1E, whose melt point is about 244 degrees Fahrenheit; 52.2 wt %/In/46 wt % Sn/1.8 wt % Zn solder, aka Indalloy 224, whose melt point is about 226; 74 wt % In/26 wt % Cd, aka Indalloy 253, whose melt point is about 253 degrees Fahrenheit; 50% Bi/28 wt % Pb/22 wt % Sn, whose melt point is about 228 degrees Fahrenheit, aka Rose's Metal.

The other objects, features and advantages of the present invention will become more apparent in light of the figures contained herein and the following detailed description thereof. Further, one of ordinary skill in the art will readily appreciate that there are alternative embodiments covered by the claims, such as that, the bore within the base of the cartridge need not be cylindrical; but, could be square, rectangular, oval, or have another cross-sectional shape.

DETAILED DESCRIPTION OF A PREFERRED EMBODIMENT OF THE INVENTION

Figures 1, 1A:
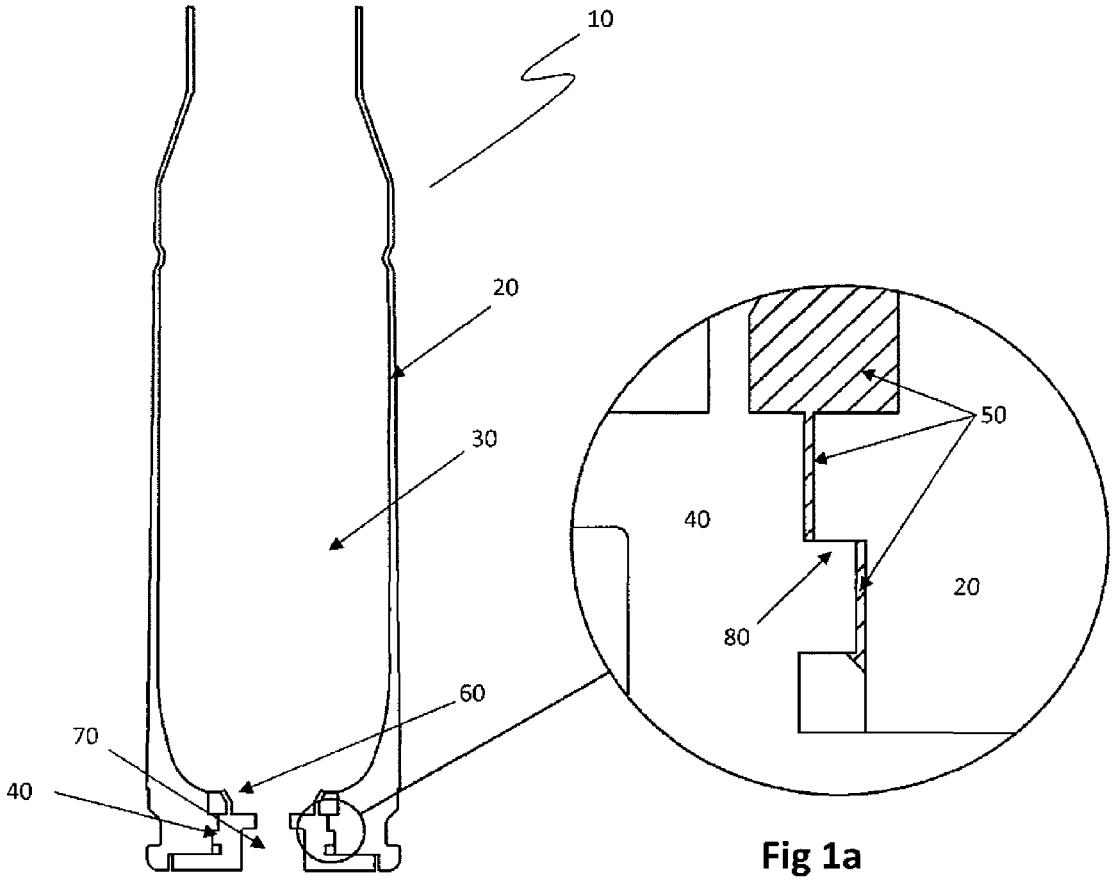
FIG. 1 is a cross-sectional view of the lower portion of a cartridge casing and base plug of the present invention within the generally cylindrical bore within the base of the cartridge casing.
FIG. 1*a* is an exploded cross-sectional view of a portion of the joint between the base and cartridge casing of the present invention, the exploded view showing two thin lengths filled with flux/solder/flux (cross hatched) and a larger space filled with a solid cylindrical wedge of solder (cross hatched) located.

As shown in FIG. 1, a steel cartridge shell, 10, of the present invention, is provided with a generally cylindrical bore, 70, central to its base and extending entirely therethrough into the central chamber, 30, formed by the cartridge shell, 10, wherein the propellant is located. A steel base plug, 40, is held within the body, 20, of the cartridge shell, 10, by a plurality of sections filled with solder, 50, which is coated on each side with flux, which solder bonds to the body, 20, on-one-side, and the plug, 40, on the other side. The flux serves a threefold purpose: it removes oxidation from the surfaces to be soldered; it seals out air thus preventing further oxidation; and, by facilitating amalgamation improves wetting characteristics of the liquid solder. Critical, as stated above, the seal formed between the steel base plug, 40, and the solder on one side, and the solder and the steel cartridge shell body, 20, on the other side, is surprisingly strong—capable of withstanding the about 72,000 psi to about 90,000 psi internal force generated upon ignition of the propellant during firing of the subject cartridge within the firing chamber of the particular weapon.

As detailed above and shown in FIG. 1*a*, the cartridge body, 20, has a shoulder extending therefrom into the bore 70. When the base plug, 40, is positioned within the bore, 70, it too has a shoulder section corresponding to and collinear with the shoulder of the cartridge—which shoulders meet and abut along line 80, shown in FIG. 1*a*. Having this abutting shoulders along line 80, allows the base plug, 40, to be properly positioned within the bore, 70. Further, the abutted set of shoulders, which intimately mate one-to-the-other, will seal the joint between the base plug, 40, and the cartridge body, 20, to prevent any of the solder located between line 80 and the interior of the cartridge body, 30, from being forced out of the subject joint during ignition and explosion of the propellant during the firing of the cartridge. The intimate joint will also prevent the pressure generated by the explosion of the propellant from affecting the solder located between the line 80 and the bottom exterior of the cartridge.

The solder filled sections, 50, may preferably be generally narrow cross-sectional sections about the base of the bore (from 0.002 to 0.005 inches in width); or they may be enlarged cross-sectional sections (with a width of at least 10 or more times greater than the 0.002)—or a combination thereof. As shown in FIG. 1*a*, a preferred embodiment of the present invention, there are three solder filled sections, 50. Two of these solder filled sections are elongated generally thin rectangles and the third is an elongated generally wider rectangle—the view of which is cut off in length—such that the upper left side thereof cannot be seen on the FIG. 1*a* detail. Preferably, there is an elongated member, 60, extending from the inside surface of the top, i.e. closest to the propellant, surface of the base plug, 40, which can be bent in and downward toward the soldered filled section, at an angle, so as to compress and hold the enlarged cross-sectional solder section in place.

As detailed above, preferred solder's useful in the present invention include eutectic melt point solders that have melt points in the range of about 220 to about 250 degrees Fahrenheit including a 52 wt % In/48 wt % Sn solder, aka In52 or Indalloy 1E, whose melt point is about 244 degrees Fahrenheit; 52.2 wt %/In/46 wt % Sn/1.8 wt % Zn solder, aka Indalloy 224, whose melt point is about 226; 74 wt % In/26 wt % Cd, aka Indalloy 253, whose melt point is about 253 degrees Fahrenheit; 50% Bi/28 wt % Pb/22 wt % Sn, whose melt point is about 228 degrees Fahrenheit, aka Rose's Metal. Preferred flux includes traditional rosin fluxes, especially non-activated (R) and mildly activated (RMA) formulations. The RMA fluxes contain rosin combined with an activating agent, typically an acid, which increases the wettability of metals to which it is applied by removing existing oxides. A most preferred flux is Indium flux #1, available from Indium Corporation, Utica, N.Y. 13502.

Not shown in the attached figures is a primer pocket or holding cup which can be manufactured integrally as part of the base plug, 40, or can be manufactured as a separate article, which can then be force fit into the central bore of the steel plug, 40. If the primer pocket is a separate article that is force fit into the steel base plug, 40, it can also be held in place with a structural, high pressure resistant adhesive to ensure that it resists the up to 90,000 psi, which it is subjected to during ignition and firing of the cartridge.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An insensitive munition (IM) type, cartridge comprising:

a propellant filled, steel, cartridge body having a base with a bore extending therethrough;

a steel base plug containing centrally therein a primer pocket, the base plug being located within said bore;

said base plug being held within said bore by a eutectic solder, whose eutectic point is from about 220 to about 250 degree F., which solder binds the base plug into the cartridge body such that the plug will remain intact within the bore during ignition and firing of the cartridge; and wherein, the base plug is held within said bore by a plurality of separate solder filled sections; and wherein, a portion of the base of the cartridge body extends as a first shoulder into said bore and there is a corresponding shoulder portion of said base plug that extends, aligns, and mates with that first shoulder to form an abutment; and wherein there is at least one solder filled section located between that abutment and the propellant filled cartridge body, and there is at least one solder filled section located between that abutment and the base end of the cartridge; and whereby, if the propellant filled cartridge is subjected to an unforeseen thermal or kinetic within the cartridge body, the solder bond between the base plug and the cartridge body will melt and the base plug will be expelled from the bore, providing venting of the propellant, preventing the propellant from exploding.

2. The insensitive munition (IM) type cartridge of claim 1, wherein, said primer pocket is manufactured integrally within said base plug.

3. The insensitive munition (IM) type cartridge of claim 1, wherein, said primer pocket is a separate article from said base plug, which is held in place within said base plug by holding means.

4. The insensitive munition (IM) type cartridge of claim 1, wherein, there are two solder fined sections located between said abutment and said propellant filled cartridge body and the section closest to the propellant filled cartridge body is wider than the second section further from the propellant filled cartridge body toward the base end of the cartridge.

5. The insensitive munition (IM) type cartridge of claim 4, wherein, there is an elongated member extending from the surface of the base plug closest to the propellant, which elongated member extends past said wider soldered filled section into the propellant filled cartridge body and is bent toward the sides of said cartridge body, so as to compress and hold the wider solder filled section in place.

6. The insensitive munition (IM) type cartridge of claim 1, wherein said a eutectic solder is selected from the group consisting of Indalloy 1E, Indalloy 224, Indalloy 253, and Rose's Metal.

7. The insensitive munition (IM) type cartridge of claim 1, wherein said bore and said steel base plug are coated with flux.

8. The insensitive munition (IM) type cartridge of claim 1, wherein said bore extending thorough said base is generally cylindrical.

9. The insensitive munition (IM) type cartridge of claim 1, wherein said bore and said base plug correspond in shape, with a wider diameter at the base end of the cartridge and a narrower diameter toward the interior of the propellant filled cartridge body.

* * * * *